United States Patent [19]

Young et al.

[11] 4,375,783

[45] Mar. 8, 1983

[54] CHIMNEY TOP SPARK ARRESTER

[76] Inventors: Lester L. Young, 961 Mitchell Canyon, Clayton, Calif. 94517; Thomas R. Young, 1413 Andover Ct., Fairfield, Calif. 94533; Michael A. Young, 2689 Shady Dr., Pinole, Calif. 94564

[21] Appl. No.: 264,106

[22] Filed: May 15, 1981

[51] Int. Cl.[3] ..... F23L 17/10; F23J 15/00

[52] U.S. Cl. ..... 98/70; 110/119

[58] Field of Search ..... 98/68, 70, 71, 78; 110/119

[56] References Cited

U.S. PATENT DOCUMENTS

| | | | |
|---|---|---|---|
| 101,123 | 3/1870 | Hahn | 98/70 |
| 204,804 | 6/1878 | Dugan | 98/70 |
| 583,847 | 6/1897 | Duhiam | 98/71 X |
| 2,152,760 | 4/1939 | Gormley | 110/119 X |
| 2,282,595 | 5/1942 | Will | 110/119 X |
| 2,720,851 | 10/1955 | Strunsky | 110/119 |
| 2,976,796 | 3/1961 | Anthony et al. | 110/119 X |
| 3,504,616 | 4/1970 | Helm | 98/70 |
| 3,715,970 | 3/1973 | Cano | 98/70 |

FOREIGN PATENT DOCUMENTS

| | | | |
|---|---|---|---|
| 946253 | 7/1956 | Fed. Rep. of Germany | 98/71 |
| 706 | of 1878 | United Kingdom | 98/68 |

*Primary Examiner*—Albert J. Makay
*Assistant Examiner*—Harold Joyce
*Attorney, Agent, or Firm*—Paul L. Hickman

[57] ABSTRACT

A spark arrester characterized by a fixed base assembly attached over the top of a chimney, a pivot assembly attached to the fixed base assembly, and a rotatable assembly rotatably coupled to the pivot assembly. The rotatable assembly is substantially cylindrically shaped having perforate sidewall portions and a perforate top portion. A vane portion of the rotatable assembly orients a windward section of the sidewall portion towards the wind, and a deflection plate attached within the sidewall portions proximate the windward section deflects the prevailing wind up through the top portion of the assembly. Co-action between the upwardly deflected wind and the underside of the vane portion creates a low pressure area over the top portion which substantially increases the draught of the chimney, resulting in reduced risk of chimney fires and an increased burn rate for airborne embers and sparks.

7 Claims, 3 Drawing Figures

CHIMNEY TOP SPARK ARRESTER

BACKGROUND OF THE INVENTION

1. Field of the Invention

This invention relates generally to chimney screens and more particularly to retrofit chimney top spark arresters.

2. Description of the Prior Art

There are a great number of chimney top spark arresters to be found in the prior art. Most of the prior art spark arresters have screened sidewalls, a perforate top, and an open bottom. The arresters often times include internal baffles designed to slow the ascent of embers and the like and are provided with means for attaching the open bottom of the structure over the top of a chimney.

A few examples of prior art spark arresters should suffice as an illustration of the pertinent prior art as a whole. In U.S. Pat. No. 2,133,506 H. Giese describes a box shaped spark arrester having four screen sidewalls and a screen top. A solid baffle plate 16 is suspended within the spark arrester to slow the ascent of the rising embers. A similar mechanism can be found in the spark arresting device of J. Slocum (described in U.S. Pat. No. 1,641,102) with the exception that the internal baffles are not solid but rather are constructed from a screen material. U.S. Pat. No. 2,058,694 of J. Johnson, and U.S. Pat. Nos. 1,709,884 and 1,997,204 of J. Slocum disclose spark arresters of similar construction to the spark arrester of U.S. Pat. No. 1,641,102.

The basic theory behind the operation of prior art spark arresters is that if the ascent of embers and sparks is sufficiently slowed down by the baffle plates the combusting materials will burn out or fall back into the chimney before being released into the ambient environment. The screen sidewalls and screen top of the spark arresters form a last line of defense to prevent the egress of potentially hazardous, burning particulate matter.

There are several problems with baffle designs of the prior art spark arresters. For one, the draught of the chimney is impaired resulting in less efficient fireplace operation. Also, if sparks and embers are not moved quickly through a chimney it is possible that they may ignite any combustible material that may have built up along the inner walls of the chimney. Furthermore, the sparks and embers may actually burn slower than if the spark arrester was not there because of the reduced draught of the chimney. In other words, the prior art spark arresters do not increase the burn rate of the sparks and embers but merely decrease their rate of egress into the ambient environment.

SUMMARY OF THE INVENTION

It is an object of this invention to provide a chimney top spark arrester that increases the draught of the chimney to which it is attached.

A further object of this invention to provide a spark arrester which increases the rate of combustion of potentially hazardous sparks and embers.

Yet another object of this invention to provide such a spark arrester that is efficient in use, that has a minimum of moving parts, and which is durable in construction.

Briefly, the invention includes a base assembly attached over the top of a chimney, and a rotatable assembly sitting on a pivot pin supported by the base assembly. The rotatable assembly has a substantially cylindrical, perforate sidewall portion, a perforate top portion, a vane portion attached to the top portion for pointing a predetermined section of the sidewall portion towards the wind, and a solid deflection plate attached within the sidewall portion for deflecting the wind up through the top portion.

The vane portion includes a saddle shaped section declining towards and attached to the top portion near the windward section of the sidewall portion. The wind directed through the top portion by the deflection plate is further channeled along the under surface of the saddle shaped section to create a low pressure condition proximate the top portion downwind of the deflection plate. This low pressure condition increases the draught of the chimney and causes sparks and embers to accelerate towards and impact the underside of the top portion where they quickly burn out.

An advantage of this invention is that the draught of the chimney is improved, thus increasing the efficiency of the fireplace and decreasing the likelyhood of a chimney fire.

Another advantage of this invention is that the sparks and embers are drawn into contact with the top portion where the heat sinking capabilities of the metal and the enhanced air flow causes them to burn out much more rapidly than they would otherwise.

Further advantages include the simplicity, efficiency and ruggedness of the device. For example, the only friction or wear point is between the pivot pin and the bracket connecting the pin to the rotatable assembly. Furthermore, the spark arrester does not require any power source other than the wind for its operation.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
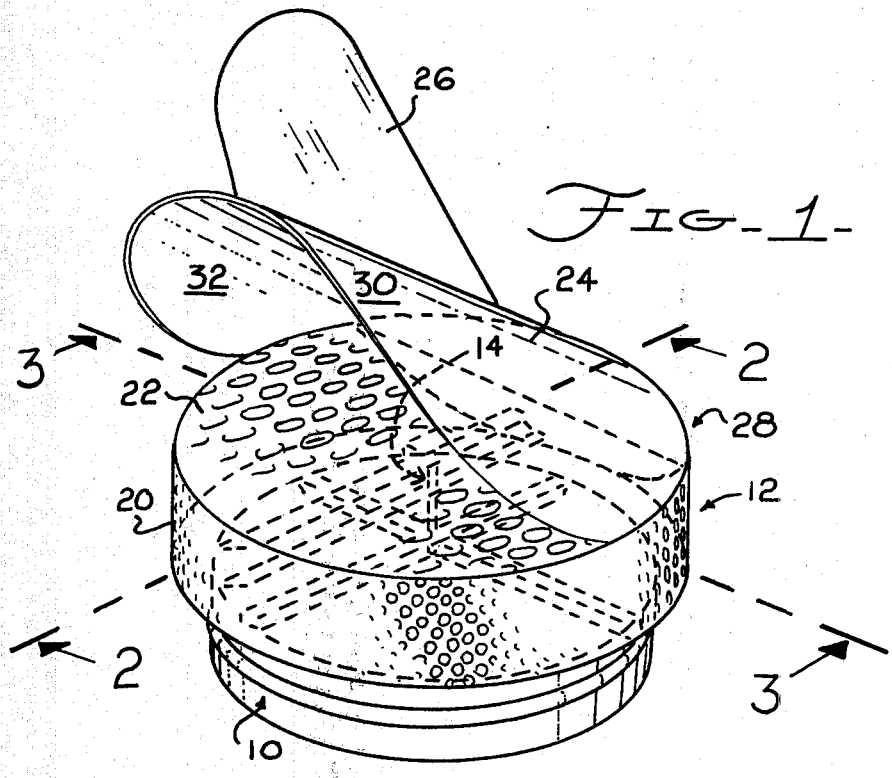
FIG. 1 is a perspective view of a chimney top spark arrester in accordance with the present invention.

Referring generally to the various figures of the drawing, a chimney top spark arrester in accordance with the present invention includes a base assembly 10, a rotatable assembly 12, and a pivot assembly 14. The pivot assembly is rigidly attached to the base assembly and is rotatably coupled to assembly 12.

The base assembly is a substantially cylindrical structure having solid, impermeable sidewall portion 16 and an open top and bottom. The sidewall portion is typically constructed from galvanized steel and may be provided with a crease 18 for increased structural strength. The bottom of the sidewall portion is adapted to attach to the top of a chimney.

The rotatable assembly has a substantially cylindrical, permeable sidewall portion 20, a permeable top portion 22, and an open bottom portion. In the present embodiment, the diameter of the rotatable member is greater than that of the base member so that the lower edge of the rotatable member can slightly overlap the upper lip of the base member. The sidewall portion 20 and the top portion 22 are preferably constructed from a perforated sheet metal material, but may also be constructed from other permeable materials such as a mesh screen. For reasons to be discussed subsequently the interstitial area is preferably greater in the top portion than in the sidewall portion.

A vane portion including a saddle shaped section 24 and a substantially vertically oriented fin 26 is attached to the top portion to orient a windward section 28 towards the prevailing wind. The saddle shaped section is attached along the upper windward edge of the sidewall 20 and has an upper surface surface 30 to which the fin 26 is attached and an under surface 32 facing top portion 22. The vane portion typically constructed from galvanized sheet metal.

Figure 3:
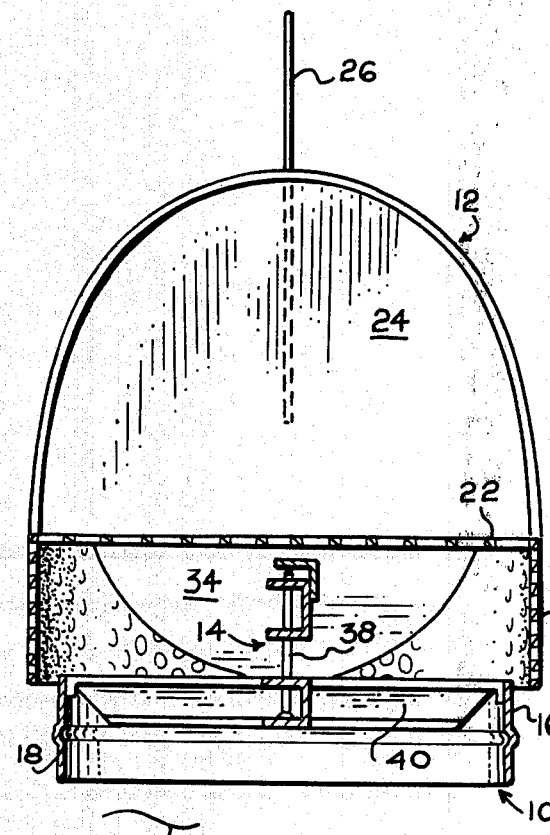
FIG. 3 is a cross-sectional view taken along line 3—3 of FIG. 1.
Figure 2:
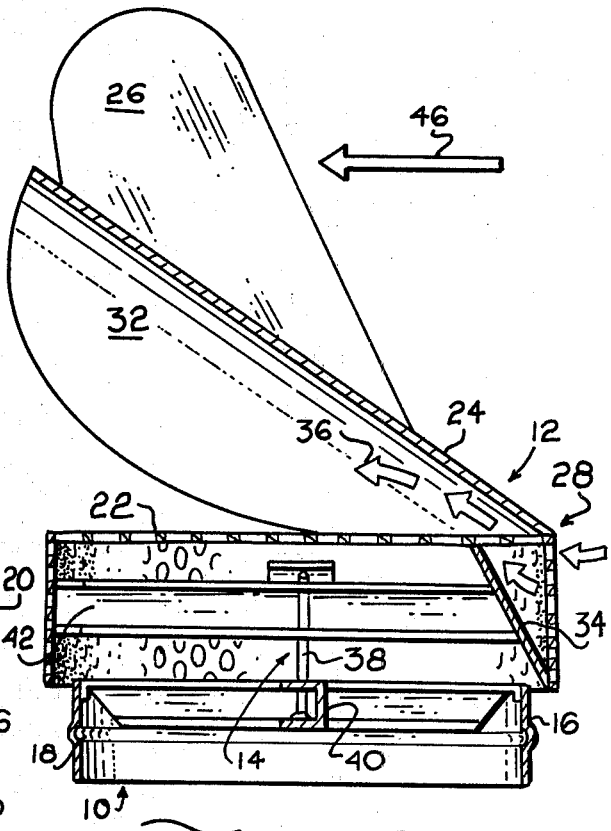
FIG. 2 is a cross-sectional view taken along line 2—2 of FIG. 1.

A deflection plate 34 is angularly disposed within the rotatable assembly and is preferably connected to both top portion 22 and to the windward section 28 of sidewall portion 20. As indicated by arrow 36 in FIG. 3, wind entering the windward section 28 is deflected up through top portion 22 by the deflection plate, and from there is directed along undersurface 32 of the saddle shaped section. As will be discussed in more detail subsequently, this channeling of air by the deflection plate and the saddle shaped section creates a low pressure area over the top portion 22 downwind of the deflection plate and thereby increases the draught of the chimney.

The pivot assembly includes a pivot pin 38, a lower support frame attached the base assembly, and an upper support frame attached to the rotatable assembly. The pivot pin is, in this embodiment, an elongated spike having a sharply pointed upper end. The lower support frame includes a pair of crossing, diametrical channel members 40 attached at their ends to sidewalls 16. An end portion of the pivot pin extends through the juncture of the channel members and is attached thereto, preferably by welding.

The upper support frame includes a "C" shaped channel member 42 and an angle bracket 44 attached to the top of the channel member. The channel member 42 diametrically attached within sidewall portion 20 and the top of angle bracket 42 is preferably attached to top portion 22. The pointed end of pivot pin 38 extends through holes formed through channel member 42 and abuts the undersurface or pivot surface of angle bracket 42. Thus, the rotatable assembly can rotate on pivot pin 38 in a relatively low friction manner and can be easily removed from the pivot assembly for maintenance, inspection, or repair.

In use, the base assembly is attached to the top of a chimney by any of the methods well known in the art. The rotatable assembly is then placed upon the pivot assembly and is checked to see if it rotates freely.

When a wind 46 is blowing the vane portion of the rotatable assembly orients the windward section 28 of the device directly into the prevaling wind. The wind 36 entering the windward section is deflected upwardly by the deflection plate 34 through the top portion 22 and at least partially along under surface 32 of the saddle shaped section. The constriction and subsequent expansion of the airflow produces the so called "venturi effect" resulting in a low pressure area over the top portion 22 downwind of the deflection plate. This low pressure area increases the draught of the chimney.

The increased draught of the chimney not only increases the efficiency of the fireplace below but it accelerates sparks, embers and other particulate matter up the chimney, substantially reducing the chances of a chimney fire. The sparks and embers are drawn to the top portion of the rotatable assembly where they are quickly extinguished by a combination of the heat-sinking properties of the metal top portion and the intensified combustion caused by the increased draught. As mentioned before, the interstitial area of the top portion is preferably greater than the interstitial area of the sidewall portion 20 so that the perforations of the top portion do not become clogged with soot, ashes and extinguished embers.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A chimney top spark arrester comprising:

(a) A base assembly including a solid impermeable sidewall portion, said assembly being adapted for attachment to a chimney top;

(b) A rotatable assembly including a permeable sidewall portion; a permeable top portion; a saddle shaped member attached to said top portion having an upper surface and an undersurface, a substantially vertical fin attached to said upper surface of said saddle shaped member to orient a windward section of said permeable sidewall portion towards a prevailing wind, said saddle shaped section being attached to said top portion proximate said windward section of said permeable sidewall portion; and a deflection plate attached within said permeable sidewall portion proximate said windward section for deflecting wind through said top portion against said saddle shaped member to create a low pressure venturi effect at an upper surface of said top portion; and (c) Pivot means coupling said base assembly to said rotatable assembly whereby said rotatable assembly can freely rotate above said base assembly.

2. A chimney top spark arrester as recited in claim 1 wherein said pivot means includes a first support member attached within said impermeable sidewall portion, a second support member attached within said permeable sidewall portion, and a pivot pin coupling said first support member to said second support member along the axis of rotation of said rotatable assembly.

3. A chimney top spark arrester as recited in claim 2 wherein said permeable sidewall portion has smaller interstices than said top portion.

4. A chimney top spark arrester as recited in claim 3 wherein said impermeable sidewall portion and said permeable sidewall portion are both substantially cylindrical, and wherein said first support member and said second support member extend substantially diametrically across said impermeable sidewall portion and said permeable sidewall portion, respectively.

5. A chimney top spark arrester as recited in claim 4 further comprising a third support member axially crossing and attached to said first support member, and wherein said pivot pin is rigidly attached to said first support member.

6. A chimney top spark arrester as recited in claim 5 wherein said second support member has a "C" shaped cross section provided with a pair of holes through which said pivot pin extends, and further comprising pivot surface means coupled to said second support member and abutting an end of said pivot pin.

7. A chimney top spark arrester as recited in claim 6 wherein said permeable sidewall portion and said top portion are constructed from perforated sheet metal.

* * * * *